US010065410B2

(12) United States Patent
Ettler

(10) Patent No.: US 10,065,410 B2
(45) Date of Patent: Sep. 4, 2018

(54) APPARATUS FOR CLEANING SURFACES

(71) Applicant: Baldwin Technology, GmbH, Friedberg (DE)

(72) Inventor: Markus Ettler, Affing (DE)

(73) Assignee: BALDWIN TECHNOLOGY, GMBH, Friedberg (DE)

( * ) Notice: Subject to any disclaimer, the term of this patent is extended or adjusted under 35 U.S.C. 154(b) by 0 days.

(21) Appl. No.: 15/584,184

(22) Filed: May 2, 2017

(65) Prior Publication Data

US 2017/0341369 A1 Nov. 30, 2017

(30) Foreign Application Priority Data

May 30, 2016 (DE) ..... 10 2016 109 911

(51) Int. Cl.

| | |
|---|---|
| ***B41F 35/00*** | (2006.01) |
| ***B41F 35/06*** | (2006.01) |
| ***B41F 35/04*** | (2006.01) |
| ***B41F 35/02*** | (2006.01) |

(52) U.S. Cl.

CPC ..... *B41F 35/06* (2013.01); *B41F 35/006* (2013.01); *B41F 35/02* (2013.01); *B41F 35/04* (2013.01); *B41P 2235/00* (2013.01)

(58) Field of Classification Search

CPC ..... B41F 35/06
USPC ..... 101/425
See application file for complete search history.

(56) References Cited

U.S. PATENT DOCUMENTS

| | | | | |
|---|---|---|---|---|
| 4,757,763 | A * | 7/1988 | MacPhee | B41F 35/06 101/425 |
| 5,282,420 | A * | 2/1994 | Hara | B41F 35/00 101/423 |
| 6,729,230 | B1 * | 5/2004 | Okawa | B08B 1/008 100/102 |
| 2003/0075065 | A1 * | 4/2003 | Loos | B41F 33/14 101/425 |
| 2003/0167949 | A1 * | 9/2003 | Kersch | B41F 33/12 101/425 |

(Continued)

FOREIGN PATENT DOCUMENTS

| | | | |
|---|---|---|---|
| DE | 19936142 | A1 | 2/2001 |
| DE | 202006003579 | U1 | 6/2006 |
| DE | 102014000043 | A1 | 7/2015 |

OTHER PUBLICATIONS

German Search Report for DE 102016109911.2 dated Dec. 22, 2016.

*Primary Examiner* — Anthony Nguyen
(74) *Attorney, Agent, or Firm* — Thompson Coburn LLP

(57) ABSTRACT

An apparatus for cleaning surfaces of a printing press has an adjusting device having a pressing element for pressing a cleaning element against the surface to be cleaned when needed. The adjusting device has a drive for moving the pressing element relative to the surface to be cleaned between a home position, in which the cleaning element is positioned at a distance from the surface to be cleaned, and a cleaning position in which the cleaning element is in contact with the surface to be cleaned or, respectively, is in the direct proximity of the surface to be cleaned. An overload safety device is configured to respond upon a critical force acting on at least one of the adjusting device or pressing element being exceeded and to move the pressing element into an overload position.

17 Claims, 2 Drawing Sheets

(56) References Cited

U.S. PATENT DOCUMENTS

| | | | | |
|---|---|---|---|---|
| 2005/0061182 | A1* | 3/2005 | Ebina | B41F 35/00<br>101/425 |
| 2005/0160933 | A1* | 7/2005 | Ruschkowski | B41F 35/00<br>101/425 |
| 2009/0260530 | A1* | 10/2009 | Sitzmann | B41F 33/08<br>101/425 |

* cited by examiner

APPARATUS FOR CLEANING SURFACES

RELATED APPLICATION DATA

This application claims the benefit of German patent application DE 10 2016 109 911.2, filed May 30, 2016, the disclosure of which is incorporated by reference herein.

SUMMARY

The present invention relates to an apparatus for cleaning surfaces.

Accordingly, the present invention relates in particular to an apparatus for cleaning surfaces, in particular for cleaning cylindrical surfaces, such as for example the surface areas of plate and blanket cylinders on the inside and outside of printing presses. The present invention is not, however, limited to the cleaning of cylindrical surfaces but rather also relates to apparatus for cleaning flat surfaces such as, for example, the surface of a flat strip material, in particular the surface of a foil or the like.

Even if the further description primarily focuses on the application of cleaning cylindrical surfaces, particularly the surface areas of printing press cylinders, this is not to constitute any limitation of the application's subject matter.

Known particularly in the field of printing technology is the use of cleaning or washing apparatus to clean cylindrical surfaces, in which a cleaning cloth passes over the surface of a rotating cylindrical object, wherein the cleaning cloth which is usually saturated with cleansing agent picks up and removes the dissolved and loosened material from the printing plate. The cleaning cloth is unwound from a clean cloth take-up roller and wound onto a dirty cloth take-up roller after use.

While a cleaning cloth, commonly moistened with a fluid, is usually used as the cleaning element to clean printing press cylinders in the known washing/cleaning apparatus, the same being drawn over the surface area of the printing press cylinder to be cleaned under slight pressure, the present invention is not limited to the use of cleaning cloths as cleaning elements. Other methods of treating and cleaning the surface to be cleaned may be used. For example, a rotating cleaning brush may be used, whereby the cleaning brush is then pressed against the surface to be cleaned with a slight pressure.

To clean the surface area of a printing press cylinder, it is necessary for the cleaning element (cleaning cloth or cleaning brush) to be pressed against the surface to be cleaned preferably at a defined, slight pressure. To that end, it is known to provide the cleaning apparatus with a pressing element which presses the cleaning element against the surface to be cleaned when cleaning thereof is needed. In this state, the pressing element is in its so-called cleaning position.

The cleaning apparatus known from the prior art has problems in that particularly in corrugated flexographic printing, the flat material (cardboard) to be printed on can adhere to the plate cylinder of the printing press and then be carried toward the cleaning apparatus. In particular, when this occurs with the pressing element of the cleaning apparatus is in its cleaning position, the cardboard being carried toward the cleaning apparatus can cause serious damage to the cleaning apparatus.

However, this risk also exists when the pressing element of the cleaning apparatus is in its so-called home position in which the cleaning element is positioned away from the surface to be cleaned. Because of the often only limited available space, cardboard adhering to the printing press plate cylinder may cause damage to the cleaning apparatus with the pressing element in its home position.

The present invention is solves these and other issues.

Accordingly, the present invention relates in particular to a cleaning apparatus for printing press cylinders or flat strip materials guided over a cylinder, wherein the cleaning apparatus has an adjusting device comprising a pressing element for pressing the cleaning element against the surface to be cleaned when needed.

As already indicated above, the cleaning element can be realized as, for example, a cleaning brush. Alternatively thereto, embodiments of the present invention provide for the cleaning element to be a cleaning cloth provided by a clean cloth take-up roller in its unused condition, whereby after the cleaning cloth has cleaned the surface to be cleaned, the used cleaning cloth winds onto a dirty cloth take-up roller.

According to the invention, the pressing element is movable with the cleaning element relative to the surface to be cleaned between a home position, in which the cleaning element is positioned at a distance from the surface to be cleaned, and a cleaning position in which the cleaning element is in contact with the surface to be cleaned or, respectively, is in the direct proximity of the surface to be cleaned.

In this context, the cleaning apparatus may comprise an adjusting device having a drive with which the pressing element can be moved, particularly linearly, relative to the surface to be cleaned. By the drive allocated to the adjusting device being able to move the pressing element when needed to and toward the surface to be cleaned, the cleaning element, for example the cleaning brush or the cleaning cloth, is preferably pressed against the surface to be cleaned at a predefined or definable contact pressure.

In order to prevent the cleaning apparatus from being damaged by defective cardboard or similar material inadvertently carried toward the cleaning apparatus, particularly in the cleaning position of the pressing element, the invention provides for an overload safety device to the cleaning apparatus which is designed so as to respond upon a predefinable or defined critical force acting on the adjusting device or pressing element being exceeded and to convey the pressing element into an overload position. Thus, defective cardboard or similar material is effectively prevented from being inadvertently carried toward the cleaning apparatus in a simple yet effective manner.

In particular, providing an overload safety device, which conveys the pressing element into an overload position when needed, is substantially more effective compared to, for example, installing deflectors or other such similar elements to prevent defective cardboard from being able to travel toward the cleaning apparatus. In practical tests, deflectors or similar elements have not proven productive since they are usually unable to be designed with enough stability, and since such deflectors or deflecting elements frequently also result in wedging the defective cardboard to an even greater degree.

Preferably, the overload position, to which the pressing element is moved upon the critical force acting on the adjusting device or the pressing element being exceeded, differs from the home position and the cleaning position of the pressing element.

As indicated above, the term "home position" as used herein refers to the position of the pressing element in which the cleaning element is disposed at a distance from the surface to be cleaned. In contrast, the "cleaning position" of the pressing element relates to a position in which the cleaning element is in contact with the surface to be cleaned or, respectively, is in the direct proximity of the surface to be cleaned.

One function of the overload safety device is to protect the cleaning apparatus, and particularly the pressing element of the cleaning apparatus, from damage when defective cardboard is inadvertently carried to the cleaning apparatus. In order to achieve this main function, it is preferably provided for the overload position, into which the pressing element is conveyed upon the critical force acting on the adjusting device or the pressing element being exceeded, to correspond to a position of the pressing element in which the pressing element is taken out of the flow of force passing from the surface to be cleaned to the pressing element. Potential damage to at least the pressing element can thus be effectively prevented.

Preferably, the overload safety device of the inventive cleaning apparatus is designed to keep the pressing element in the overload position after the critical force acting on the adjusting device or the pressing element has been exceeded.

It is conceivable in this context, however, to further develop the overload safety device so as to preferably automatically, and even more preferentially selectively automatically, convey the pressing element back into the cleaning position or, when needed, back into the home position as soon as the force acting on the pressing element from the surface to be cleaned falls below a predefinable or defined critical value. "Selectively automatically" here means that the operator of the cleaning apparatus can himself determine whether the pressing element should be able to be automatically or manually conveyed from the overload position back into the cleaning position or the home position again.

In structural terms, there are different possibilities of realizing the overload safety device.

It is thereby advantageous for the overload safety device to be of regenerative design. "Regenerative" in this context means that after the overload safety device responds, it preferably does not need to be replaced in order to continue providing its function.

Conceivable in this regard is, for example, for the overload safety device to comprise a mechanism designed to respond upon the exceeding of the critical force acting on the adjusting device or the pressing element of the cleaning apparatus and to convey the pressing element into the overload position pursuant to a predefined sequence of events.

It is particularly conceivable in this regard for the mechanism to comprise a guide which is designed to convey the pressing element into the overload position in a guided motion upon activation of the overload safety device. It is particular advantageous for the mechanism to be designed to convey the pressing element into the overload position in a linear motion, circular motion or a superposition of linear and circular motion upon the activation of the overload safety device.

According to one particular embodiment of the inventive solution, it is provided for the overload safety device to comprise a preferably spring-loadable lever mechanism, in particular a toggle lever mechanism, which is designed to respond upon the critical force acting on the adjusting device or the pressing element being exceeded and to convey the pressing element into the overload position.

Conceivable in this regard is, for example, pre-setting the (critical) actuation force of the overload safety device by way of the initial spring tension of the spring-loaded lever mechanism.

However, the invention is not limited to such spring-loaded lever mechanisms; other embodiments for realizing the overload safety device are in fact also conceivable.

Preferably, the adjusting device is mechanically connected to a base element of the cleaning apparatus together with the pressing element, whereby said base element is preferably implemented as a carriage or carriage arrangement able to move relative to and along the surface to be cleaned.

In this context, it is conceivable with respect to the overload safety device for it to be at least partly of destructive design and comprise at least one breakaway or shear-off element which responds upon the exceeding of the critical force acting on the adjusting device or the pressing element of the cleaning apparatus and thereby loses its connecting function for mechanically connecting the adjusting device or the pressing element to the base element of the cleaning apparatus so that the adjusting device/pressing element will then be removed from the flow of force introduced from the surface to be cleaned.

Providing such destructively designed breakaway or shear-off elements has the advantage of being able to realize a very precise predefining of the actuation force for the overload safety device in particularly simple manner.

According to embodiments of the inventive cleaning apparatus, a sensor device is further provided which detects whether the pressing element is in the overload position. The sensor device is in particular designed so as to emit a corresponding warning signal to a control device upon detecting that the pressing element is in the overload position. This warning signal emitted by the sensor device indicates an operating fault in, for example, the presence of defect cardboard. Depending on programming, the control device can then automatically switch off the printing press or initiate other measures.

As stated above, it is particularly conceivable for the adjusting device of the inventive cleaning apparatus to comprise a drive with which the pressing element can be moved, in particular displaced, relative to the surface to be cleaned. By the drive allocated to the adjusting device being able to move the pressing element as needed relative to and toward the surface to be cleaned, the cleaning element, e.g. the cleaning brush or the cleaning cloth, is pressed against the surface to be cleaned.

So as to be able to obtain optimal cleaning quality, embodiments of the present invention in particular provide for the adjusting device to have a variably adjustable feed limitation, by means of which a maximum displacement path of the pressing element relative to the surface to be cleaned able to be realized by the drive of the adjusting device can be defined in each case.

Because the maximum realizable displacement path of the pressing element relative to the surface to be cleaned can be variably adjusted by means of said feed limitation, the actuation force of the cleaning element or, respectively, the contact pressure exerted by the cleaning element on the surface to be cleaned can be easily individually adjusted to the respective application and to the respective individual case without great effort. In so doing, the surface pressure necessary to achieving a specific cleaning result can always be obtained in the cleaning position of the pressing element.

Cleaning efficiency thereby usually involves softening or dissolving adherent particles of dirt, for example from residual ink and paper dust, with the aid of a solvent coupled with simultaneous particle abrasion. The contaminants and solvent are removed by the utilized cleaning element which is pressed against the surface to be cleaned in an axially extending contact zone by the adjusting device and associated pressing element.

Using a cleaning cloth as the cleaning element in the inventive cleaning apparatus lends itself to periodically providing the cleaning zone with new, clean strips of cleaning cloth since the structure of the cloth fabric limits the absorbing capacity for dirt. The cleaning cloth is thereby advanced by being unwound from a supply roll (clean cloth take-up roller) onto a dirty roll (dirty cloth take-up roller). The contaminants absorbed by the cleaning cloth end up as a layer wrapped up in the dirty cloth take-up roller.

The above-noted drive of the pressing device is used to press the cleaning element (cleaning brush or cleaning cloth) against the surface to be cleaned. According to one aspect of the present invention, the drive associated with the pressing device is realized as an electric, and in particular pneumatic, drive, particularly a linear drive.

In one conceivable realization of the inventive solution, a rubber strip extending over the entire length of the surface to be cleaned is used to press the cleaning element against said surface to be cleaned. Since a rubber strip exhibits no appreciable flexural rigidity, the rubber strip is preferably arranged on and affixed to a supporting strip preferably formed in a rigid metal or plastic profile.

Alternatively thereto, it is however also conceivable for the inventive cleaning apparatus not to extend over the entire length and/or width of the surface to be cleaned but rather be designed as a wash bar arranged on a cross beam, whereby the wash bar can then be moved in the longitudinal direction of the surface to be cleaned preferably periodically or pursuant to a preset operational sequence.

The following will reference the drawings in describing an example embodiment of the inventive cleaning apparatus used to clean a printing press cylinder in greater detail.

DETAILED DESCRIPTION

Figure 1:
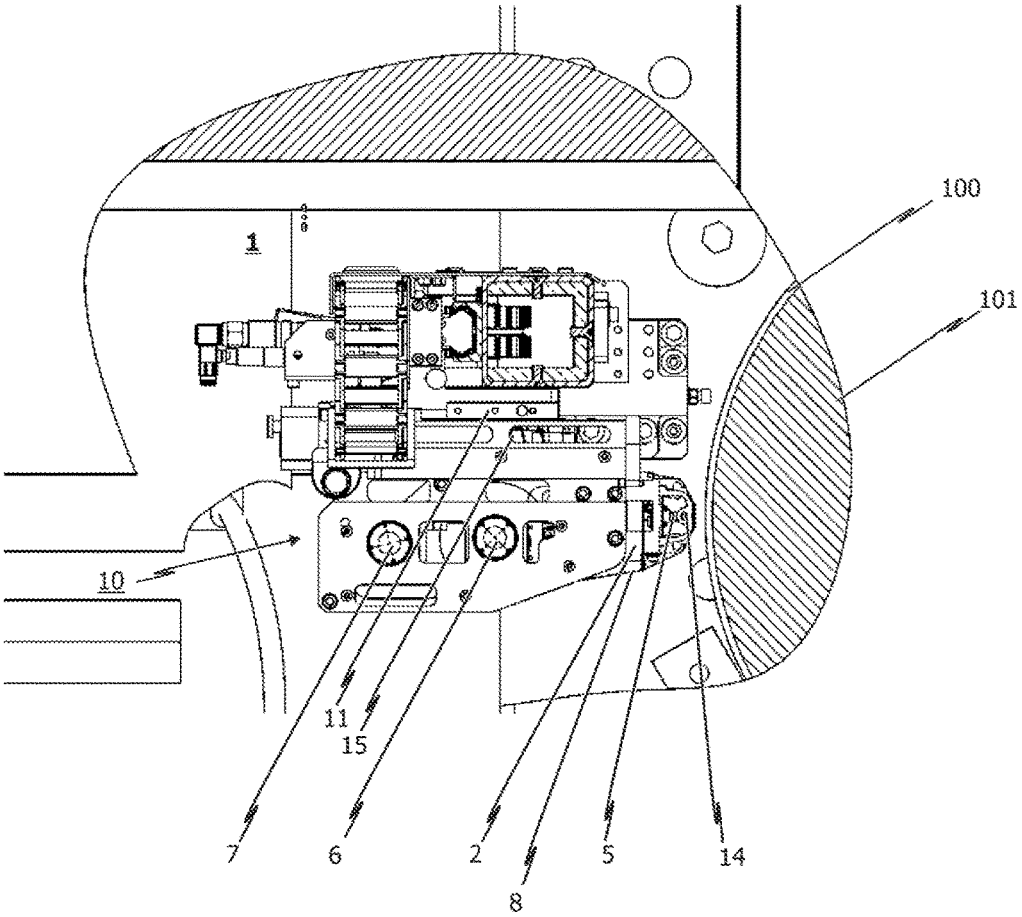
FIG. 1 a schematic side view of an example embodiment of the cleaning apparatus according to the invention which is realized as a wash bar for cleaning and/or washing the surface area of a printing press cylinder, wherein the pressing element of the cleaning apparatus is in its home position.

The accompanying drawings will be referenced below in describing an example embodiment of the inventive cleaning apparatus 1.

The example embodiment depicted in the drawings relates specifically to an apparatus 1 for cleaning the surface areas 100 of a printing press cylinder 101 configured as a wash bar. The cleaning apparatus 1 is in particular suitable for cleaning blanket cylinders of offset printing presses, thus cylinders 101 covered by a rubber blanket which serve to transfer the print image to the actual impression cylinder.

During printing, little by little, impurities, essentially printing ink and dust, get left behind on the rubber blanket. These contaminants need to be periodically removed if a qualitatively flawless print image is to be produced. Cleaning the rubber blanket from time to time is therefore a common practice.

To that end, the example embodiment of the inventive cleaning apparatus 1 depicted schematically in the drawings can be used.

The invention is not, however, limited to the cleaning of blanket cylinders which transfer a print image. In fact, the inventive cleaning apparatus 1 is also suited to cleaning flexo, steel or chrome cylinders. Use with cast cylinders or calendars respectively of film extrusion machines is also conceivable. Accordingly, the inventive apparatus can not only remove dust (paper dust) and ink from the surface of the object to be cleaned but also film particles, extrusion particles, etc.

The printing press cylinder 101, which can be washed/cleaned by the cleaning apparatus 1 depicted in the drawings and configured as a wash bar, can however also be a different cylinder or any other cylinder of an offset printing press or other printing press.

To clean the surface area 100 of the printing press cylinder 101, the cleaning apparatus 1 depicted as an example in FIG. 1 comprises a cleaning element 8 in the form of a cleaning cloth.

As indicated schematically in FIG. 1, the example embodiment of the inventive cleaning apparatus 1 is arranged opposite from the cylinder 101 of a printing mechanism of a printing press, for example opposite a web-print rubber blanket cylinder of a web-fed rotary offset press, wherein the cleaning apparatus 1 is periodically activated for the purpose of cleaning the surface area 100 of the cylinder 101.

The cleaning apparatus 1 comprises an adjusting device with a pressing element 5, in front of which runs the cleaning element configured as a cleaning cloth opposite from the surface area 100 of the cylinder 101 to be cleaned. A conventionally designed cloth drive unwinds the cleaning element 8 configured as a cleaning cloth from a supply roll (clean cloth take-up roller 6).

For the purpose of cleaning the surface area 100 of the cylinder 101, the adjusting device provided with the pressing element 5 shifts from the rest position (home position) indicated in FIG. 1 into a cleaning position, which is a position in which the cleaning element 8 designed as cleaning cloth presses against the cylinder 101. The required contacting position, or cleaning position respectively, for the contact of the cleaning cloth is effected by the action of variable contact pressure, on which the frictional force depends.

Preferably, the contact pressure and/or the maximally effectable displacement path from the rest position (home position) out toward the surface 100 to be cleaned is variably adjustable, and namely by the maximally realizable path of displacement of the pressing element 5 relative to the surface 100 to be cleaned being individually specified by means of an adjustable feed limitation.

Although not recognizable in FIG. 1, it is preferably provided for the adjusting device to comprise a drive, by means of which the pressing element 5 can be moved relative to the cylinder surface 100 to be cleaned. Specifically, a pneumatic drive is used as the adjusting device drive in the example embodiment of the inventive cleaning apparatus 1 depicted in the drawings.

The pneumatic drive in particular comprises a pneumatic cylinder disposed between a carriage arrangement 2 and a baseplate of the cleaning apparatus 1. The carriage arrangement 2, on which the pressing element 5 is arranged, is displaceable toward the surface 100 to be cleaned relative to the baseplate upon actuation of the pneumatic cylinder.

To this end, an actuating element extends from the pneumatic cylinder in the example embodiment of the inventive cleaning apparatus 1 depicted in the drawings, striking the strike surface of a stop in order to thereby define the degree to which the actuating element can be extended. The cited stop defines a feed limitation in this example embodiment, by means of which the maximum displacement of the pressing element 5 able to be realized by the drive relative to the surface 100 to be cleaned can be specified.

When the pressing element 5 is extended out of its home position shown in FIG. 1 toward the surface 100 to be cleaned for the purpose of cleaning the cylinder surface 100, whereby the cleaning element configured as a cleaning cloth is pressed against the cylinder 101 to be cleaned in this cleaning position, there is the risk of larger particles such as for example defect cardboard being inadvertently transported along over the cylinder 101 into the region in which the cleaning element is being pressed against the surface 100 of the cylinder 101 by the pressing element. In such a situation, there is the danger of the cleaning apparatus 1 being damaged, and in particular the pressing element 5 of the cleaning apparatus 1.

In order to therefore effectively protect the cleaning apparatus 1 from such damage, the inventive cleaning apparatus 1 comprises an overload safety device which is designed which is designed to respond upon a predefinable or defined critical force acting on the adjusting device or the pressing element 5 being exceeded and to convey the adjusting device with the pressing element 5 into an overload position.

Figure 2:
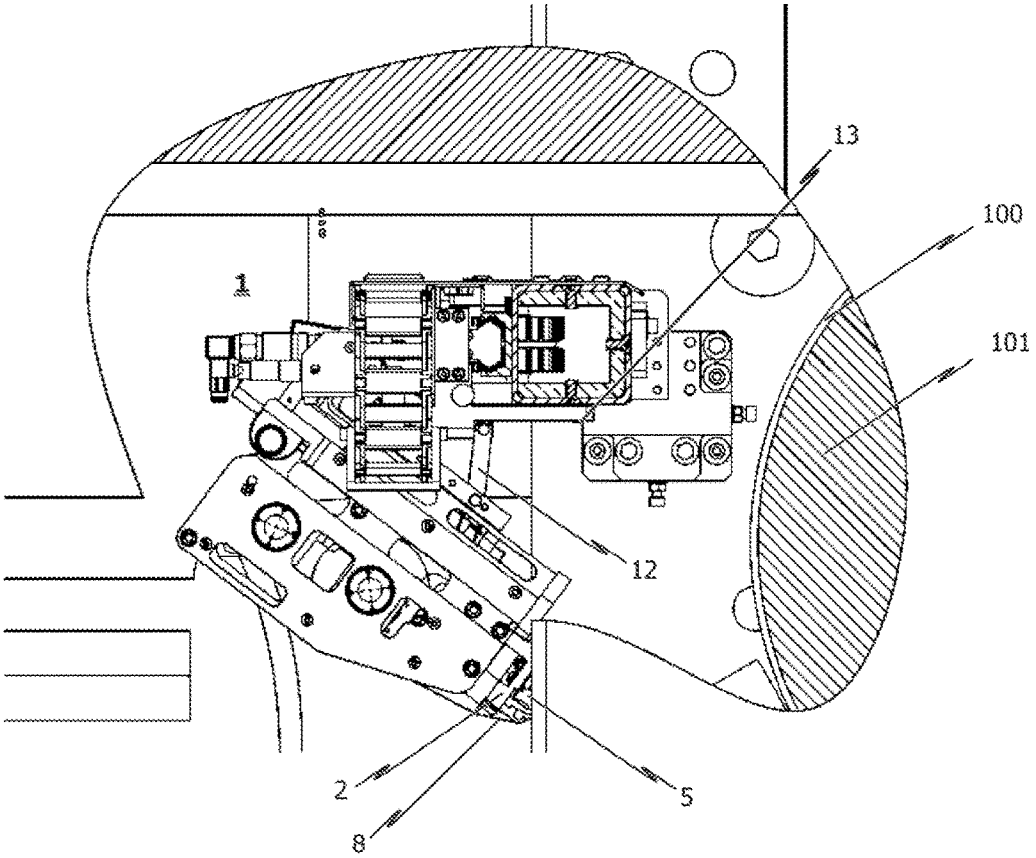
FIG. 2 a schematic side view of the example embodiment of the inventive cleaning apparatus according to FIG. 1 in a state in which the adjusting device is in the overload position.

FIG. 2 shows a schematic view of the example embodiment of the inventive cleaning apparatus 1 according to FIG. 1 is in its overload position.

It is evident that the overload safety device employed in the example embodiment of the inventive cleaning apparatus 1 depicted in the drawings is designed such that upon the predefinable or defined critical force acting on the adjusting device or pressing element 5 respectively being exceeded, the adjusting device and the pressing element 5 are conveyed into an overload position which is different from the home position and the cleaning position of the pressing element 5.

Specifically, the overload position in the embodiment depicted in the drawings is selected so as to correspond to a position of the adjusting device, or the pressing element 5 respectively, in which the adjusting device and the pressing element 5 are removed from a flow of force transmitted from the surface 100 to be cleaned to the pressing element 5.

In the embodiment of the inventive cleaning apparatus depicted schematically in the drawings, the overload safety device comprises a spring-loaded toggle lever mechanism which is designed to respond upon the critical force acting on the adjusting device or the pressing element 5 being exceeded and convey the adjusting device with the pressing element 5 into the overload position shown in FIG. 2. The adjusting device and the pressing elements 5 are thereby conveyed into the overload position according to a preset sequence of events. To this end, the adjusting device and the pressing element are conveyed by a guided motion into the overload position when the overload safety device is actuated.

Although the overload safety device in the example embodiment depicted in the drawings exhibits a mechanism designed to convey the adjusting device and the pressing element into the overload position in a circular motion when the overload safety device is actuated, it is nonetheless conceivable for the adjusting device and the pressing element to be conveyed into the overload position in a linear motion or in a superposition of linear and circular motion upon activation of the overload safety device.

The present invention is also not limited to an overload safety device comprising a preferably spring-loaded toggle lever mechanism to convey the adjusting device and the pressing element into the overload position upon activated overload safety device. Other mechanisms, particularly lever mechanisms, are in fact also conceivable for this conveyance.

The example embodiment of the inventive cleaning apparatus depicted in the drawings is characterized by the overload safety device being of completely regenerative design.

In detail, and as can be noted from the FIG. 2 depiction, the overload safety device is designed to hold the adjusting device and the pressing element 5 in the overload position after the critical force acting on the adjusting device and on the pressing element 5 has been exceeded.

Furthermore, the overload safety device is preferably designed to thereafter convey the adjusting device with the pressing element 5 back into the home position or the cleaning position, wherein this requires no components of the overload safety device being replaced.

Alternatively hereto, it would however also be conceivable for the overload safety device to be of at least partly destructive design and comprise at least one breakaway or shear-off element which responds upon the exceeding of the critical force acting on the adjusting device or the pressing element 5 and thereby loses its original connecting function such that the adjusting device and the pressing element are then removed from the flow of force conducted from the surface 100 to be cleaned.

The invention is not limited to the example embodiment of the inventive washing apparatus 1 depicted in the drawings but rather yields from an integrated consideration of all the features disclosed herein in context.

The invention claimed is:

1. An apparatus (1) for cleaning a surface of a printing press, the apparatus (1) comprising:

an adjusting device having a pressing element (5) configured to press a cleaning element against the surface (100) to be cleaned, the adjusting device being configured to move the pressing element (5) in linear motion relative to the surface (100) to be cleaned between a home position, in which the cleaning element is positioned at a distance from the surface (100) to be cleaned, and a cleaning position in which the cleaning element is in contact with the surface (100) to be cleaned; and an overload safety device (10) being configured to sense when a force applied to at least one of the adjusting device and the pressing element (5) exceeds a defined force limit, and in response thereto, move the pressing element (5) to an overload position;

wherein the overload safety device (10) is configured to move the pressing element (5) into the overload position in one of a linear motion, a circular motion, and a superposition of linear and circular motion upon the activation of the overload safety device (10).

2. The apparatus according to claim 1, wherein the overload position differs from the home position and the cleaning position.

3. The apparatus according to claim 1, wherein the overload position corresponds to a position of the pressing element (5) in which the pressing element (5) is not in contact with the surface (100) to be cleaned.

4. The apparatus according to claim 1, wherein the overload safety device (10) is configured to keep the pressing element (5) in the overload position after the first force applied on the one of the adjusting device and the pressing element (5) exceeds the defined force limit.

5. The apparatus according to claim 1, wherein the overload safety device (10) is configured to move the pressing element (5) back into the cleaning position as soon as the first force applied on the one of the adjusting device and the pressing element (5) falls below a second defined force limit.

6. The apparatus according to claim 1, wherein the overload safety device (10) is regenerative.

7. The apparatus according to claim 6, wherein the overload safety device (10) comprises a mechanism (11) configured to respond upon the exceeding of the defined force limit and move the pressing element (5) into the overload position pursuant to a predefined sequence of events.

8. The apparatus according to claim 7, wherein the mechanism (11) comprises a guide which is designed to convey the pressing element (5) into the overload position in a guided motion upon activation of the overload safety device (10).

9. The apparatus according to claim 6, wherein the overload safety device (10) comprises a spring-loaded lever mechanism (12) configured to respond upon exceeding the defined force limit and move the pressing element (5) into the overload position.

10. The apparatus according to claim 1, wherein the adjusting device together with the pressing element (5) is mechanically connected to a base element of the cleaning apparatus (1).

11. The apparatus according to claim 10, wherein the base element is configured to move relative to and along the surface (100) to be cleaned.

12. The apparatus according to claim 10, wherein the overload safety device (10) comprises at least one frangible element (13) which upon the exceeding of the defined first force limit, mechanically disconnects the at least one of the adjusting device and the pressing element (5) from the base element of the cleaning apparatus (1) such that the at least one of the adjusting device and pressing element (5) respectively is moved away from the surface (100) to be cleaned.

13. The apparatus according to claim 1, wherein a sensor device (14) is configured to detect whether the pressing element is in the overload position and emit a corresponding warning signal.

14. The apparatus according to claim 1, wherein the adjusting device comprises a variably adjustable feed limitation for the selective defining of a maximum displacement path of the pressing element (5) able to be realized by the drive relative to the surface (100) to be cleaned.

15. The apparatus according to claim 14, wherein the feed limitation (10) comprises a stop (15) having a strike surface for limiting the maximum displacement path of the pressing element (5) able to be realized by the drive relative to the surface (100) to be cleaned.

16. The apparatus according to claim 14, wherein the apparatus is configured to selectively automatically set the feed limitation as at least one of a function of the diameter of a cylinder (101) to be cleaned and a function of a contact pressure.

17. The apparatus according to claim 1, wherein the cleaning element (8) comprises a cleaning cloth, and wherein the apparatus (1) further comprises a clean cloth take-up roller (6) for supplying unused cleaning cloth; and a dirty cloth take-up roller (7) for receiving used cleaning cloth; and wherein the pressing element (5) is designed to press the cleaning cloth provided by the clean cloth take-up roller (6) against the surface (100) to be cleaned as needed.

* * * * *